US006097919A

United States Patent [19]

Takeuchi et al.

[11] Patent Number: 6,097,919

[45] Date of Patent: Aug. 1, 2000

[54] IMAGE FORMING APPARATUS

[75] Inventors: Akihiko Takeuchi, Susono; Tatsuya Kobayashi, Soka; Toshiaki Miyashiro, Shizuoka-ken; Naoki Enomoto, Susono; Takaaki Tsuruya, Mishima, all of Japan

[73] Assignee: Canon Kabushiki Kaisha, Tokyo, Japan

[21] Appl. No.: 09/218,087

[22] Filed: Dec. 22, 1998

[30] Foreign Application Priority Data

Dec. 26, 1997 [JP] Japan ..... 9-359064

[51] Int. Cl.[7] ..... G03G 15/01

[52] U.S. Cl. ..... 399/298; 399/66; 399/302

[58] Field of Search ..... 399/298, 302, 399/308, 66; 430/42, 124, 126

[56] References Cited

U.S. PATENT DOCUMENTS

| | | | |
|---|---|---|---|
| 4,822,702 | 4/1989 | Hoshi et al. | 430/42 |
| 4,931,839 | 6/1990 | Tompkins et al. | 399/66 |
| 5,112,710 | 5/1992 | Shimura et al. | 430/42 X |
| 5,270,138 | 12/1993 | Kaneko et al. | 430/42 X |
| 5,347,345 | 9/1994 | Osterhoudt | 399/231 |
| 5,541,029 | 7/1996 | Iwata et al. | 430/42 X |
| 5,627,629 | 5/1997 | Takehashi et al. | 430/42 X |
| 5,640,645 | 6/1997 | Namekata et al. | 399/66 |
| 5,774,762 | 6/1998 | Takemoto et al. | 399/66 X |

*Primary Examiner*—Matthew S. Smith
*Attorney, Agent, or Firm*—Fitzpatrick, Cella, Harper & Scinto

[57] ABSTRACT

In an image forming apparatus according to the present invention, the toner images of the plural colors on the intermediate transfer member are electrostatically transferred to a transfer material, and the image forming charges the toner image of a color, among the toner images of the plural colors formed on the intermediate transfer member, different from the last color in such a manner that the charge amount per unit weight of the toner image of the different color becomes 0.5 to 1.5 times of the charge amount per unit weight of the toner image of the last color, after the formation of the toner image of the last color on the intermediate transfer member and prior to the transfer of the toner images of the plural colors on the intermediate transfer member to the transfer material.

23 Claims, 5 Drawing Sheets

IMAGE FORMING APPARATUS

BACKGROUND OF THE INVENTION

1. Field of the Invention

The present invention relates to an image forming apparatus in which a toner image formed electrostatically on an image bearing member is transferred onto a transfer material.

2. Related Background Art

In the conventional color image forming apparatus based on electrophotographic process, there is known a configuration provided with an intermediate transfer member in addition to a photosensitive member. In such configuration, there is repeated plural times so-called primary image transfer in which a toner image formed on the photosensitive drum is transferred onto the intermediate transfer member to superpose toner images of plural colors thereon, and then there is executed secondary image transfer in which such toner images of plural colors are collectively transferred onto a transfer material such as paper.

FIG. 6 shows an example of the image forming apparatus employing an intermediate transfer belt as the image bearing member.

Around a photosensitive drum 101 supported rotatably in a direction R1, there are provided four developing units 105, 106, 107, 108 respectively containing toners of four colors, namely black (BK), cyan (C), magenta (M) and yellow (Y). These developing units are so constructed that one unit therein, used for developing the electrostatic latent image present on the photosensitive drum 101, is brought into abut thereon by contact means (not shown).

The photosensitive drum 101 is uniformly charged by a charger 102, and an electrostatic latent image is formed by a scanning light (laser beam) 104 emitted by a laser exposure light source 103. The electrostatic latent image is then developed, by toner deposition by the above-mentioned developing units 105 etc., into a toner image, which is transferred, by a primary image transfer, onto an intermediate transfer belt. 109 at a primary transfer nip $N_1$ with a primary transfer roller 110. The formation, development and primary transfer of the electrostatic latent image are repeated with the toners of four colors, employing the developing units 108, 107, 106, 105, in the order of Y, M, C and BK, whereby four superposed color toner images are formed on the intermediate transfer belt 109. Then, these toner images are collectively transferred, in a secondary image transfer, onto a transfer material 118 which is pinched and conveyed at a secondary transfer position $N_2$ formed between a secondary transfer roller 111 and the intermediate transfer belt 109.

In the following the primary and secondary transfers mentioned above will be explained in more details. In case the photosensitive drum 101 is composed of a negatively chargeable OPC (organic photoconductor) photosensitive member, negative toners are employed for developing the areas, exposed to the laser beam 104, in the developing units 105 to 108. Thus a positive transfer bias voltage is applied by a bias electrode 120 to the primary transfer roller 110.

The intermediate transfer belt 109 can be composed, for example, of an endless resinous belt of a thickness of about 100 to 300 $\mu$m, of which resistance is adjusted to a volumic resistivity of $10^{11}$ to $10^{16}$ Ω.cm. The resinous belt can be composed, for example, of a resinous film (subjected to resistance adjustment if necessary) of PVDF (polyvinylidene fluoride), nylon, PET (polyethylene terephthalate) or polycarbonate. As another example, the above-mentioned resinous belt may adjusted to a volumic resistivity of $10^7$ to $10^{11}$ Ω.cm with conductive filler material such as carbon, ZnO, $SnO_2$ or $TiO_2$. A medium to low resistance level in the latter example allows to prevent image defects resulting from charge accumulation on the intermediate transfer belt 109.

As still another example, the intermediate transfer belt 109 can also be composed of a rubber material (chloroprene rubber, EPDM, NBR or urethane rubber) of a lower hardness, having a thickness of about 0.5 to 2 mm and adjusted to a volumic resistivity of $10^6$ to $10^{11}$ Ω.cm.

Such intermediate transfer belt 109 is supported by a backup roller 112, a drive roller 115 and a tension roller 116. The primary transfer roller 110 is generally of a low resistance, having a volumic resistivity of $10^5$ Ω.cm or less. In the above-described configuration, the primary transfer roller 110 and the bias voltage source 120 constitute primary transfer means.

Then the toner images are subjected to the secondary transfer onto the transfer material 118, by secondary transfer means consisting of a secondary transfer roller 111, the backup roller 112 and the bias voltage source 120. The secondary transfer is executed by positioning a backup roller 112 of a low resistance, grounded or suitably biased, as a counter electrode inside the intermediate transfer belt 109, forming a secondary transfer nip $N_2$ between the backup roller 112 and an outside secondary transfer roller 111 of a low resistance, across the intermediate transfer belt 109, applying a positive transfer bias to the secondary transfer roller 111 by the bias voltage source 120 and abutting the secondary transfer roller 111 from the rear face side of the transfer material 118.

After the primary transfer mentioned above, the photosensitive drum 101 is subjected to the removal of the toner, remaining after the primary transfer, by a cleaner 119, then to the removal of retentive charge by an exposure device 117, and is used again for the next image formation.

On the other hand, the intermediate transfer belt 109 after the above-mentioned secondary transfer is subjected to the removal of the toner, not transferred to the transfer material 118 but remaining on the intermediate transfer belt 109, by a cleaner 113 and, if necessary, to the charge elimination by a charge eliminator (charge eliminating means) 114.The charge eliminator 114 usually utilizes AC corona charging. For improving the efficiency of charge elimination, an electrode is preferably provided inside the intermediate transfer belt 109.

The above-described charge eliminator 114 may be dispensed with in case the intermediate transfer belt 109 is of medium to low resistance as explained in the foregoing.

The intermediate transfer member can also be formed as a drum-shaped intermediate transfer dram instead of the intermediate transfer belt 109 explained in the foregoing, but, in comparison with such intermediate transfer drum, the intermediate transfer belt 109 is generally superior in the larger freedom of arrangement and in the better separation of the transfer material 118 after the secondary transfer (possibility of separation by curvature).

On the other hand, the intermediate transfer drum can simplify the structure, in comparison with the belt drive required for the intermediate transfer belt. The configuration of such intermediate transfer drum will not be explained further, as the resin or rubber layer formed on the surface of such drum can have electrical characteristics similar to those in case of the intermediate transfer belt.

In the above-described apparatus, the images with the toners of four colors Y, M, C and BK are conventionally formed at first with three colors Y, M, C in an arbitary order and with the black color BK at last.

Such order of image formation has been widely adopted since the multiple transfer process, which precedes the intermediate transfer process and in which the images are transferred in succession onto a transfer material such as paper wound on a rotatable transfer drum. As the black image generally has a larger amount of information such as characters in comparison with the images of other colors, the black toner, if primary transferred as the first to third colors, may re-transferred to the photosensitive member at the primary transfer of the subsequent color thereby inducing a loss of the black toner as a result of such re-transfer, and the above-mentioned order has been adopted to avoid such phenomenon. For this reason, after the secondary transfer of the toners onto the transfer material 118, the BK toner is present at the lower most layer (closest to the surface of the transfer material).

The conventional configuration described above has been associated with the following drawbacks. At the successive primary transfer of the color toner images from the photosensitive drum 101 to the intermediate transfer belt 109, the toner of the first color transferred onto the intermediate transfer belt 109 is retained thereon during the successive transfer of the toners of second to fourth colors, and, during such transfer of the toners of second to fourth colors, there takes place a charge exchange between the toner of the first color and the photosensitive drum 1 or the intermediate transfer belt 109, whereby, at the end of the primary transfer of the toner of the fourth color, the charge or tribo (triboelectricity) of the toner of the first color becomes different from that at the primary transfer of the toner of the first color. As a result, the secondary transfer condition becomes different for the toners of the first to fourth colors present on the intermediate transfer belt, particularly between the toners of the first and fourth colors. As a result, in the above-described configuration, the defective secondary transfer may result in the BK toner of the fourth color if the bias of the secondary transfer roller 111 is matched with the Y toner of the first color for obtaining a higher transfer efficiency, or in the Y toner of the first color if the bias is matched with the BK toner of the fourth color, or there may result a change in the color hue due to a lowered transfer efficiency.

In order to avoid such phenomena, there is conceived a method of so-called post-charging in which the triboelectric charges of the toners of the first to fourth colors on the intermediate transfer belt are re-charged to a substantially same level, prior to the secondary transfer, by a corona charger 122 receiving a DC voltage and an AC voltage, but such methods not only involves a more complex structure of the apparatus and a higher cost but also encounters difficulty in bringing the tribo of the toners of the first to fourth colors to a uniform charge level, thereby resulting in a defect such as image unevenness in the highlight portion in a halftone image.

Also there has been considered a method of recovering the toner, remaining on the intermediate transfer belt 109 after the secondary transfer, by re-charging such remaining toner to a suitable level and collecting (inverse transferring) such remaining toner to the photosensitive drum 101 through the primary transfer nip $N_1$, but, if such recovery is not executed in a particular rotation step of the drum but at the primary transfer of the toner of the first color in the next image formation, such recovery cannot be achieved satisfactorily if there is employed a high bias voltage for such transfer of the first color. If non-magnetic toner, showing a high charge amount per unit area, is employed as the toner of the first color, the efficiency of primary transfer is lowered if the primary transfer bias is lowered according to the condition of the above-mentioned cleaning.

SUMMARY OF THE INVENTION

An object of the present invention is to provide an image forming apparatus capable of achieving satisfactory transfer of toner images of plural colors from an image bearing member to a transfer material, while not causing unevenness in the color hue, without complication in the configuration of the apparatus.

Other objects of the present invention, and the features thereof, will become fully apparent from the following detailed description which is to be taken in conjunction with the accompanying drawings.

DETAILED DESCRIPTION OF THE PREFERRED EMBODIMENTS

Now the present invention will be clarified in detail by preferred embodiments thereof, with reference to the accompanying drawings.

Embodiment 1

Figure 1:
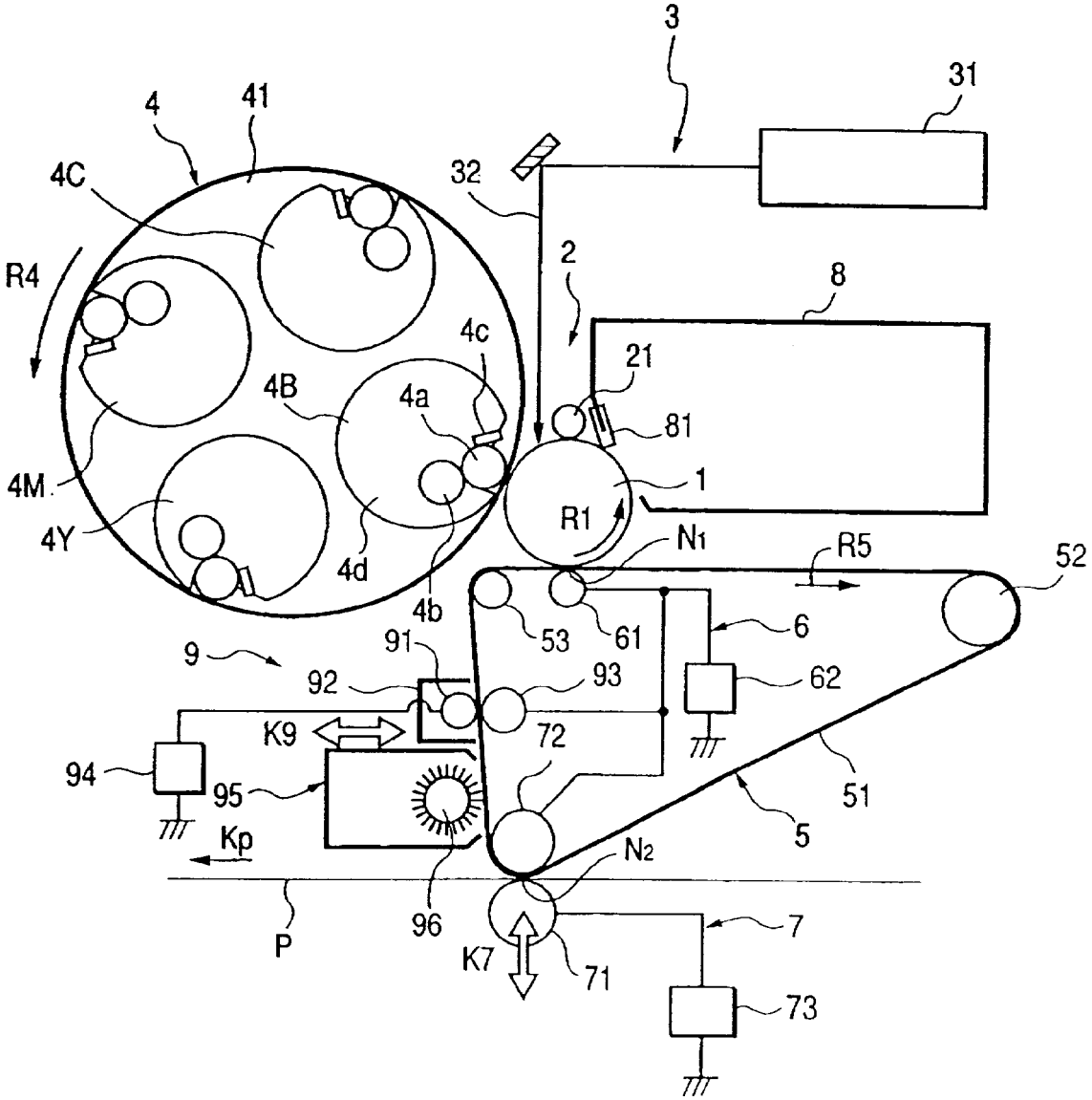
FIG. 1 is a longitudinal cross-sectional view of an image forming apparatus constituting an embodiment 1.

FIG. 1 is a schematic view showing the configuration of an image forming apparatus constituting an embodiment 1 of the present invention. In the following, the configuration of the entire apparatus and the functions thereof will be briefly explained with reference to FIG. 1.

Referring to FIG. 1, an image bearing member 1 is composed of a drum-shaped electrophotographic photosensitive member (hereinafter called photosensitive drum 1). The photosensitive drum 1 composed of a cylindrical aluminum substrate and an OPC (organic photosemiconductor) photosensitive layer covering the surface thereof, and is rotated in direction R1 by drive means (not shown).

Image forming means is provided with photosensitive member charging means 2, exposure means 3 and developing means 4. The photosensitive member charging means 2 is provided with a charging roller 21 positioned in contact with the photosensitive drum 1, and a power source (not shown) for applying a charging bias voltage thereto. In the present embodiment 1, the surface of the photosensitive drum 1 is uniformly charged to a negative potential (dark potential) by the power source through the charging roller 21.

The exposure means 3 is provided with a laser optical system 31, which exposes the surface of the photosensitive drum 1 with a scanning laser beam 32 modulated according to the image information, thereby dissipating the charge in the exposed area and forming an electrostatic latent image (light portion).

The developing means 4 is provided with a rotary member 41 and four developing units 4B, 4Y, 4M, 4C mounted thereon and respectively containing developers (toners) of black, yellow, magenta and cyan colors. Among these developing units, the-one of the color used for developing the electrostatic latent image formed on the photosensitive drum 1 is brought into a developing position opposed to the surface of the photosensitive drum 1, by the rotation of the rotary member 41 in a direction R4. These four developing units are constructed similarly, and the black developing unit 4B, for example, is provided with a rotatable developing sleeve 4*a*, a coating roller 4*b* coating toner on the surface of thereof, and an elastic blade 4*c* for limiting the thickness of the toner layer on the developing sleeve 4*a*, thereby giving a charge to the one-component non-magnetic negative toner contained in a toner container 4*d* and uniformly coating the toner on the developing sleeve 4*a*. The electrostatic latent image on the photosensitive drum 1 is reversal developed by black toner deposition, caused by application of such a developing bias to the photosensitive drum 1 that the developing sleeve 4*a* becomes negative in relative manner.

An image bearing member 5 is principally composed of an intermediate transfer belt (intermediate transfer member) 51, which is constituted by an endless flexible belt member of a thickness of 0.5 to 2 mm and which is supported by a drive roller 52, an idler roller 53 and a secondary backup roller 72 to be explained later and is rotated in a direction R5. The intermediate transfer belt 51 is supported between the photosensitive drum 1 positioned at the surface (external periphery) side and a primary transfer roller 61, to be explained later, positioned at the rear surface (internal periphery) side, and, between the surface of the intermediate transfer belt 51 and the surface of the photosensitive drum 1, there is formed a stripe-shaped primary transfer nip portion (first transfer position) $N_1$ along the generatrix on the surface of the photosensitive drum 1.

First transfer means 6, constituting the image forming means, is provided, at a position opposed to the photosensitive drum 1, with a primary transfer roller 61 maintained in contact with the rear surface of the intermediate transfer belt 51 and a transfer bias source 62 for applying a primary transfer bias thereto. The black toner image formed on the photosensitive drum 1 is primary transferred onto the intermediate transfer belt 51, by the application of a primary transfer bias of +300 to 500 V to the primary transfer roller 61 from the transfer bias source 62. The photosensitive drum 1 after the primary transfer is cleaned, by scraping of the remaining toner from the surface with a cleaning blade 81 of a cleaner 8, and is subjected to the next cyan image formation.

The image forming process consisting of the above-described steps of charging, exposure, development, primary transfer and cleaning is repeated for other three colors, namely yellow, magenta and cyan, whereby the toner images of four colors are formed in mutually superposed manner on the intermediate transfer belt 51. The primary transfer bias is elevated in succession from the first color to the fourth colors, for example +400 V, +600 V, +700 V and +800 V.

Second transfer means 7 is provided with a secondary transfer roller 71 positioned at the surface side of the intermediate transfer belt 51, and a secondary backup roller 72 positioned at the rear surface side, and these two rollers 71, 72 support the intermediate transfer belt 51 to form a stripe-shaped secondary transfer nip portion (second transfer position) $N_2$ between the surface of the secondary transfer roller 71 and the intermediate transfer belt 51. The secondary transfer roller 71 is connected to a transfer bias source 73 for applying a secondary transfer bias thereto, while the secondary backups roller 72 is maintained in an electrically floating state. The toner images of four colors, formed by the primary transfers on the intermediate transfer belt 51, are subjected to secondary transfer in collective manner onto a transfer material P such as paper, by the application of the secondary transfer bias to the secondary transfer roller 71.

The intermediate transfer belt 51 after the secondary transfer is subjected to cleaning of the toner, not transferred onto the transfer material P in the secondary transfer but remaining on the belt surface, by cleaning means 95 provided with a fur brush 96 (or a blade), and then to elimination of the remaining charge by charge eliminating means 9. The charge eliminating means 9 is provided with a charge eliminating roller 91, a housing 92 movable in a direction K9, and an auxiliary roller 93 opposed thereto across the intermediate transfer belt 51. The housing 92 is moved in a direction K9 together with the cleaning means 95 to position the intermediate transfer belt 51 between the charge eliminating roller 91 and the auxiliary roller 93, and a predetermined bias voltage is applied by a cleaning bias source 94 to eliminate the toner remaining after the secondary transfer and the remaining charge thereby initializing the surface of the intermediate transfer belt 51. The above-mentioned charge elimination is made possible with contact charging means, instead of corona discharge, as one of the effects obtained by employing low-resistance rubber in the substrate of the intermediate transfer belt 51 as will be explained later in more details.

On the other hand, the transfer material P, which has received the secondary transfer of the toner images of four colors by the aforementioned second transfer means 7, is conveyed in a direction Kp, then subjected to heat and pressure in a fixing device (not shown) for fixing the toner images, and is discharged from the main body of the image forming apparatus.

In the above-described image forming process, the process speed vp is set at 10.0 cm/sec, and the transfer material P is conveyed in a direction Kp by transfer material conveying means (not shown).

In the following there will be given more detailed description on the image bearing member 5, second transfer means 7 and charge eliminating means 9.

The intermediate transfer belt 51 is composed of an endless shaped substrate 51*a* and a coated layer formed thereon. The substrate is composed for example of NBR (nitrile butadiene rubber) or EPDM (ethylene propylene rubber) of a hardness of about 60° in JIS-A measurement and a volumic resistivity adjusted to about $1\times10^4$ ω.cm by the addition of carbon, titanium oxide or tin oxide, and such material was seamless formed into a cylindrical shape of a thickness of 1 mm, a width of 220 mm and a peripheral length of about 140 πmm. The substrate of a high strength with limited elongation could be obtained, for example, by sandwiching reinforcing yarns between two rubber sheets obtained by extrusion molding and vulcanizing the composite.

The coated layer of high resistance provided on the substrate was composed of a releasing agent such as Teflon dispersed in a urethane binder, and was coated with a thickness of about 50 μm. The coating can be made by spray coating, dip coating or other coating methods. The resistance of the coating material constituting the coated layer was adjusted by selecting a urethane material of a volumic resistivity in a range of about $10^{12}$ to $10^{16}$ Ω.cm. Thus, the volumic; resistivity of the intermediate transfer member is preferably within a range of about $10^{12}$ to $10^{16}$ Ω.cm.

In the following there will be explained the second transfer means 7.

The secondary transfer roller 71 in the second transfer means 7 was composed of a rubber roller, composed of foamed EPDM with a hardness of about 40° (determined by Ascar C measurement) and a volumic resistivity of about $10^4$ Ω.cm. There may also be employed urethane rubber, chloroprene rubber or NBR of low resistance. The transfer bias source 73 was so adjusted as to apply a voltage of about +1000 to +2000 V and to obtain a transfer current of about 10 μA when a sheet is passed.

Charge eliminating means 9 is provided with a charge eliminating roller 91, which was composed of a material similar to that of the charging roller 21. The charging roller 21 utilizes the known contact charging method, and was formed by a conductive rubber layer of a thickness of about 3 mm, an intermediate resistance layer of a thickness of 100 to 200 μm and a volumic resistivity of $10^6$ Ω.cm formed thereon, and a sticking prevention layer (nylon resin etc.) of a thickness of several tens micrometers formed thereon. As the charge eliminating voltage, the cleaning bias source 94 applied a bias voltage consisting of an AC peak-to-peak voltage Vpp of about 3 kV superposed with a DC voltage of about 100 to 1000 V, and the opposed auxiliary roller 93 was maintained at a potential same as that of the primary transfer roller 61.

In the following there will be explained the developer employed in the present embodiment.

The developer of each color was composed of non-magnetic one-component negative toner basically composed of polyester resin. Such toner is described in detail, for example in the Japanese Patent Laid-open Application No. 5-158282.

More specifically, the binder resin of the toner principally contains polyester resin formed from a monomer composition at least containing the following components (a), (b), (c) and (d), wherein the polyester resin has a hydroxyl value within a range of 10 to 20, a weight-averaged molecular weight within a range of 13000 to 20000, a number-averaged molecular weight within a range of 5000 to 8000, and a ratio of weight-averaged molecular weight (Mw)/number-averaged molecular weight (Mn) within a range of 2 to 3.5:

(a) a divalent aromatic acid component selected from isophthalic acid, terephthalic acid and derivatives thereof, within a range of 25 to 35 mol. % of the total monomer amount;

(b) a trivalent aromatic acid component selected from trimellitic acid and derivatives thereof, within a range of 2 to 4 mol. % of the total monomer amount;

(c) a divalent acid component selected from dodecenylsuccinic acid, octylsuccinic acid and derivatives thereof, within a range of 12 to 18 mol. % of the total monomer amount; and (d) propoxylized and/or ethoxylized etherized diphenol component, within a range of 45 to 60 mol. % of the total monomer amount.

The above-mentioned base substance of toner was suitably colored with a coloring material, then subjected to mixing, kneading, crushing and classifying steps to obtain classified toner particles with a diameter of 4 to 8 μm. 100 parts by weight of thus obtained classified particles were added and mixed with 1 to 2 parts by weight of silica, processed with dimethylsilicone oil, as the charge controlling agent, to obtain non-magnetic one-component color toner chargeable negatively. In this operation, the black toner to be used for primary transfer of the first color was prepared by adding, to the base substance, 3 to 5 parts by weight of conductive carbon particles for forming leak sites in order to relax the charge retaining ability of the toner, then effecting the mixing, kneading, crushing and classifying steps to obtain the classified toner particles.

The charge amount per unit weight (hereinafter called "tribo" (triboelectric charge amount)) of the above-mentioned toners on the developing sleeve 4*a* was measured by directly attracting the toner and determined from the amount of attracted toner and the current generated in this operation. It was about −18 μC/g for the black toner and about −30 μC/g for the Y, M and C color toners. These values were determined under the conditions of 23° C. and 60% RH.

Figure 2:
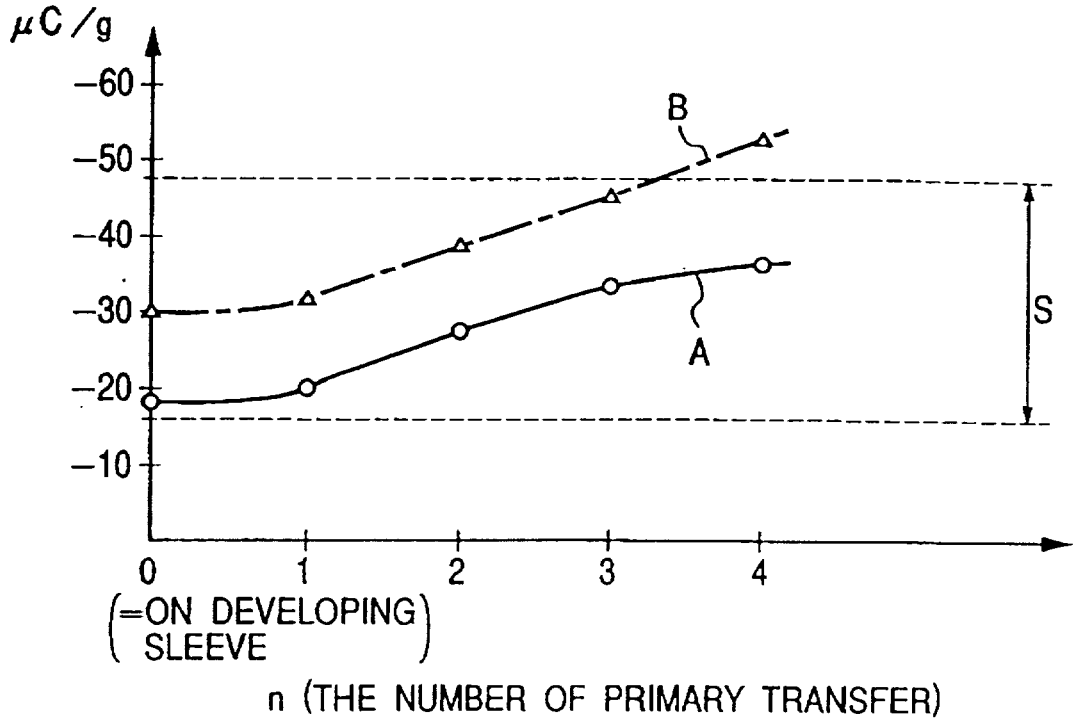
FIG. 2 is a chart showing the relationship between the number of primary transfers and the tribo charge of the toner in the embodiment 1.

Then toner images were formed with the above-mentioned toners on the intermediate transfer belt 51, and the triboelectric charge amount of the toner thereon was measured. FIG. 2 shows the triboelectric charge amount of the black toner after the primary transfers of the first to fourth colors, wherein (A) indicates the case of the present invention while (B) indicates the case of conventional toner (reference example) which does not contain carbon as the leak sites, except for a small amount of carbon black employed as the coloring material. In FIG. 2, an area S indicates the range of triboelectric charge amount of the toner for which the secondary transfer efficiency becomes acceptable when the secondary transfer bias is so selected that the secondary transfer can be satisfactorily achieved for the C toner used for the fourth color. In this experiment, the secondary transfer bias was selected as about: +1500 V, and the area S was so determined as to obtain a secondary transfer efficiency of 85% or higher. As a result, the area S had a lower limit of about: −16 μC/g and an upper limit of about −48 μC/g, while the C toner used for the fourth color had a charge amount, per unit weight of about −32 μC/g after the primary transfer onto the intermediate transfer belt 51. Therefore, the toners on the intermediate transfer belt 51, after the primary transfers of all the four colors, can achieve satisfactory secondary transfer if the triboelectric charge amounts of the toners are within a range of about 0.5 to 1.5 times of that of the toner of the fourth color. In the present invention, as shown in FIG. 2, owing to the effect of the leak sites in the toner, the charge amount of the black toner used as the first color is within the area S even after the four primary transfers. On the other hand, in the conventional toners, the triboelectric charge amount of the black toner used as the first color gradually increases by receiving negative charges from the photosensitive drum 1 in the primary transfers of the second to fourth colors, and eventually goes out of the area S after the primary transfer of the fourth color, whereby satisfactory secondary transfer cannot be achieved (resulting in deterioration of color hue). In the case (A) of the present invention, the limited increase and eventual saturation of the triboelectric charge amount is realized by a fact that the leak sites in the toner suppresses the saturated charge amount per unit weight of toner, in comparison with that in the conventional toner. This can be verified from a fact that the curve A for the black toner, in FIG. 2, becomes substantially saturated after four transfer steps. Therefore, in a system in which the triboelectric charge amount of the toner gradually increases with the repetition of the primary transfers, it is rendered possible to improve the secondary transfer operation succeeding the four primary transfers and to widen the transfer margin for achieving satisfactory collective secondary transfer for all the colors, by selecting a lower saturated charge amount per unit weight for the toner of the first color than that of the other toners.

Also for the toners of the second and third colors, it is preferred to select the triboelectric charge amount on the intermediate transfer belt 51, after the primary transfers but prior to the secondary transfer, within a range of 0.5 to 1.5 times of that of the toner of the fourth color. However, as already explained in the present embodiment, the toners of the second and third colors have less chances of acquiring the charge at the primary transfer nip $N_1$ of the photosensitive drum 1, in the succeeding primary transfer operations, in comparison with the toner of the first color, so that the saturation charging characteristics and the triboelectric charge amount can be made substantially same in the toners of the second to fourth colors as explained in the present embodiment. Naturally the above-mentioned properties may be somewhat adjusted, if necessary, for this toners of the second and third colors. Also the saturated charge amount per unit weight of toner can be measured, in a simpler manner, by conducting the above-described primary transfer plural times (about 4 to 10 turns). More specifically, after the toner image is formed on the photosensitive drum 1 and transferred onto the intermediate transfer belt 51, it is rotated by a predetermined number of times under the condition-of executing the primary transfer, during which the photosensitive drum 1 is charged by the photosensitive member charging means 2. In the present embodiment, the black toner was saturated at about −25 $\mu$C/g, while the Y, M and C toners were saturated at about −60 $\mu$C/g. Naturally there may also be employed other suitable measuring methods (such as charging the toner with magnetic powder and measuring the obtained charge).

As shown in FIG. 2, the triboelectric charge amount of the black toner increased from −18 $\mu$C/g to −25 $\mu$C/g, with an absolute increase of 7 $\mu$C/g, while that of the C toner increased from −30 to −60 $\mu$C/g with an absolute increase of 30 $\mu$C/g.

Therefore, the triboelectric charge amount on the developing sleeve of the C toner to be transferred as the fourth color is preferably within a range of 1.5 to 4.0 times of that of the black toner to be transferred as the first color, and also the amount of increase of the triboelectric charge amount is preferably smaller in the black toner than in the C toner. Also for the toners of the second and third colors, the triboelectric charge amount on the developing sleeve is preferably within a range of 1.5 to 4.0 times of that of the toner of the first color, and the amount of increase of the triboelectric charge amount is preferably larger than in the toner of the first color. With such toners, immediately after the primary transfer of the toner of the fourth color, the triboelectric charge amounts of the toners of the first to third colors are within a range of 0.5 to 1.5 times of that of the toner of the fourth color.

In the present embodiment, the black toner is selected as the first color, and such selection is preferred because carbon, if employed as the leak sites, matches the color of the toner. In the system where the saturated charge amount per unit weight of black toner is lowered as in the present embodiment, the reverse transfer of the black toner to the photosensitive drum 1 in the second to fourth primary transfers, a phenomenon encountered in the prior configuration, has not be observed. Also the secondary transfer was satisfactory in a light halftone portion of BK, Y, M and C images.

Embodiment 2

The embodiment 2 of the present invention provides an example of employing a magnetic one-component negative developer as the black toner and non-magnetic one-component negative developers by polymerization process as the Y, M and C toners. The configuration of the apparatus is same as that in the embodiment 1 and will not, therefore, be explained further.

The classified particles of the black toner had the following composition:

styrene/butyl acrylate/divinylbenzene copolymer 100 parts by weight (weight ratio 80/19.5/0.5, weight-averaged molecular weight 320,000)

triiron tetraoxide (ave. particle size 0.5 $\mu$m) 80 parts by weight azo dye Cr complex 1 part by weight Low-molecular propylene-ethylene copolymer 4 parts by weight These components were subjected mixing, kneading, crude crushing and classifying steps to obtain classified toner particles of a particle size of about 4 to 8 $\mu$m.

100 parts by weight of the above-mentioned classified toner particles were added and mixed with 1.2 parts by weight of silica treated with dimethylsilicone oil to obtain one-component insulating magnetic toner chargeable negatively.

In the black developing unit 4B shown in FIG. 1, a fixed magnet is provided inside the developing sleeve 4*a* to applying a magnetic restraining force to the toner at a position opposed to the photosensitive drum 1. In the present embodiment, the toner is only rubbed by an elastic blade 4*c* while the coating roller 4*b* is dispensed with in providing the toner with the triboelectric charge and achieving uniform toner coating on the developing sleeve 4*a*.

The Y, M or C toner was composed of sharp melting toner which was prepared by a polymerization process and in which internally added was a releasing agent such as wax or paraffin having a melted viscosity and a molecular weight smaller than those in the matrix resin of toner. Such toners achieve satisfactory color mixing, and, at the image fixation, wax oozes cut from the toner by the applied heat to improve the releasing effect in the thermal roller fixing device (not shown), which is commonly employed for image fixation, thereby achieving an oil-less structure.

The polymerized toner mentioned above shows a substantially spherical particle shape, because of the preparation process. The polymerized toner employed had a configuration containing esterized wax as the core portion, a styrene-acrylate resin layer and a surfacial styrene-polyester resin layer.

The toner had a specific gravity of about 1.05, and had a three-layered structure because the was contained as the core provides an offset preventing effect at the image fixing operation and the surfacial resin layer improves the charging efficiency. At the actual use of the toner, oil-treated silica was externally added for stabilizing the triboelectric charge.

The polymerization in the present embodiment was executed by suspension polymerization under normal or elevated pressure, capable of relatively easily providing fine toner particles of a particle size of 4 to 8 $\mu$m with a sharp particle size distribution (cf. Japanese Patent Publication No. 36-10231, Japanese Patent Laid-open Application Nos. 59-53856 and 59-61842), employing styrene and n-butyl acrylate as the monomers, a metal salicylate as the charge controlling agent, saturated polyester as the porous resin and a coloring agent, thereby obtaining colored suspension particles of a weight-averaged particle size of 7 μm.

The toner suitable for use in the present: embodiment can be obtained by controlling the particles size and the particle size distribution, for example by modifying the kind and amount of the low-water-soluble inorganic salt or the dispersing agent capable of forming protective colloid, or the mechanical conditions of the apparatus such as the peripheral speed or roller or the number of passes, or the agitating condition such as the shape of the agitating blades, or the shape of the container or the solid content in the aqueous solution.

As the coloring agent for the above-mentioned toners, there can be employed following substances. Examples of the yellow color agent include condensed azo compounds, isoindolinone compounds, anthraquinone compounds, azo metal complexes, methine compounds, and allylamide compounds.

Also examples of the magenta coloring agent include condensed azo compounds, dichetopyrrolopyrrle compounds, anthraquinone compounds, quinachrydone compounds, basic dye takes, naphthol compounds, benzimidazolone compounds, thionindigo compounds, and peryllene compounds.

Also examples of the cyan coloring agent include copper phthalocyanine compounds, derivatives thereof, anthraquinone compounds, and basic dye rakes.

The developing units for the Y, M and C toners mentioned above were substantially same as the developing units 4Y, 4M, 4C (and 4B) of the embodiment 1 shown in FIG. 1 and will not therefore be explained further.

The triboelectric charge amount of the above-mentioned toners on the developing sleeve 4*a* was measured by directly attracting the toner and determined from the amount of attracted toner and the current generated in this operation. It was about −10 μ/g for the magnetic black-toner and about −30 μC/g for the Y, M and C color toners. These values were determined under the conditions of 23° C. and 60% RH.

Then toner images were formed with the above-mentioned toners on the intermediate transfer belt 51, and the triboelectric charge amount of the toner thereon was measured. Also in the present embodiment, the developments were executed in the order of B, Y, M and C as in the embodiment 1. In these operations, the optimum primary transfer biases were respectively +150, +600, +700 and +800 V. The primary transfer bias for the first black toner was lower than in the embodiment 1 because the black toner on the developing sleeve 4*a* had a lower triboelectric charge.

Figure 3:
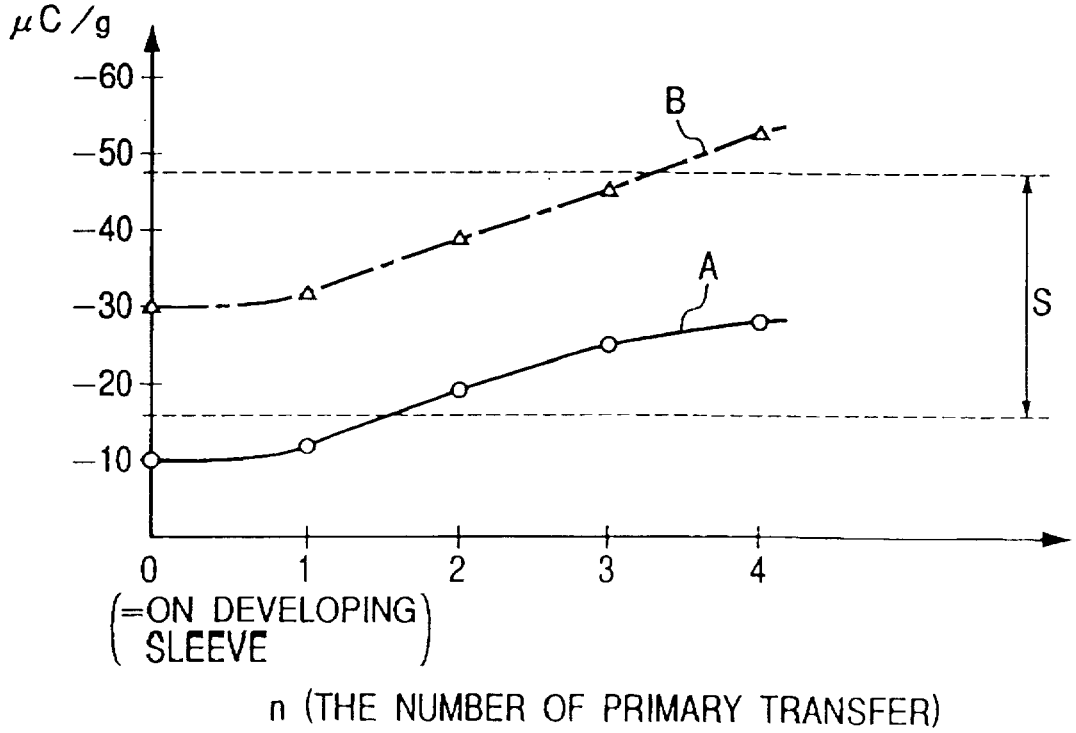
FIG. 3 is a chart showing the relationship between the number of primary transfers and the triboelectric charge of the toner in the embodiment 2.

FIG. 3 shows the triboelectric charge amount of the black toner after the primary transfers of the first to fourth colors (solid line A), and that of a reference example (chain line B) in which the M toner of the present embodiment was employed in the first color. Also in the present embodiment, as in FIG. 2, an area S indicates the range of triboelectric charge amount of the toner for which the secondary transfer efficiency becomes acceptable (about 85% or larger) when the secondary transfer bias is so selected that the secondary transfer can be satisfactorily achieved for the C toner used for the fourth color. Also in the present embodiment, the area S become largest with a lower limit of about −6 μC/g and an upper limit of about −48 μC/g, when the secondary transfer bias was selected as about +1500 V. On the other hand, as indicated by the solid line A in FIG. 3, the black toner does not reach the lower limit of triboelectric charge of −16 μC/g required for appropriate secondary transfer at first turn (n=1) which is immediately after the primary transfer but sufficiently reach the triboelectric charge required for the secondary transfer after fourth turn (about −25 μC/g in FIG. 3).

On the other hand, the M toner represented by the chain line B for comparison showed gradual increase of the triboelectric charge, reaching about −53 μC/g after fourth turn, well beyond the upper limit −48 μC/g. Thus, in the present embodiment, a satisfactory result can be obtained by employing the black toner for the first color and other toners for the second and subsequent colors, but defective secondary transfer will result in the toner of the first color by an excessively triboelectric charge if non-black toner is employed for the first color. Also defective transfer or toner scattering will result at the secondary transfer, in the toner of the fourth color by a deficient triboelectric charge if the black toner is employed for the fourth color.

Figure 6:
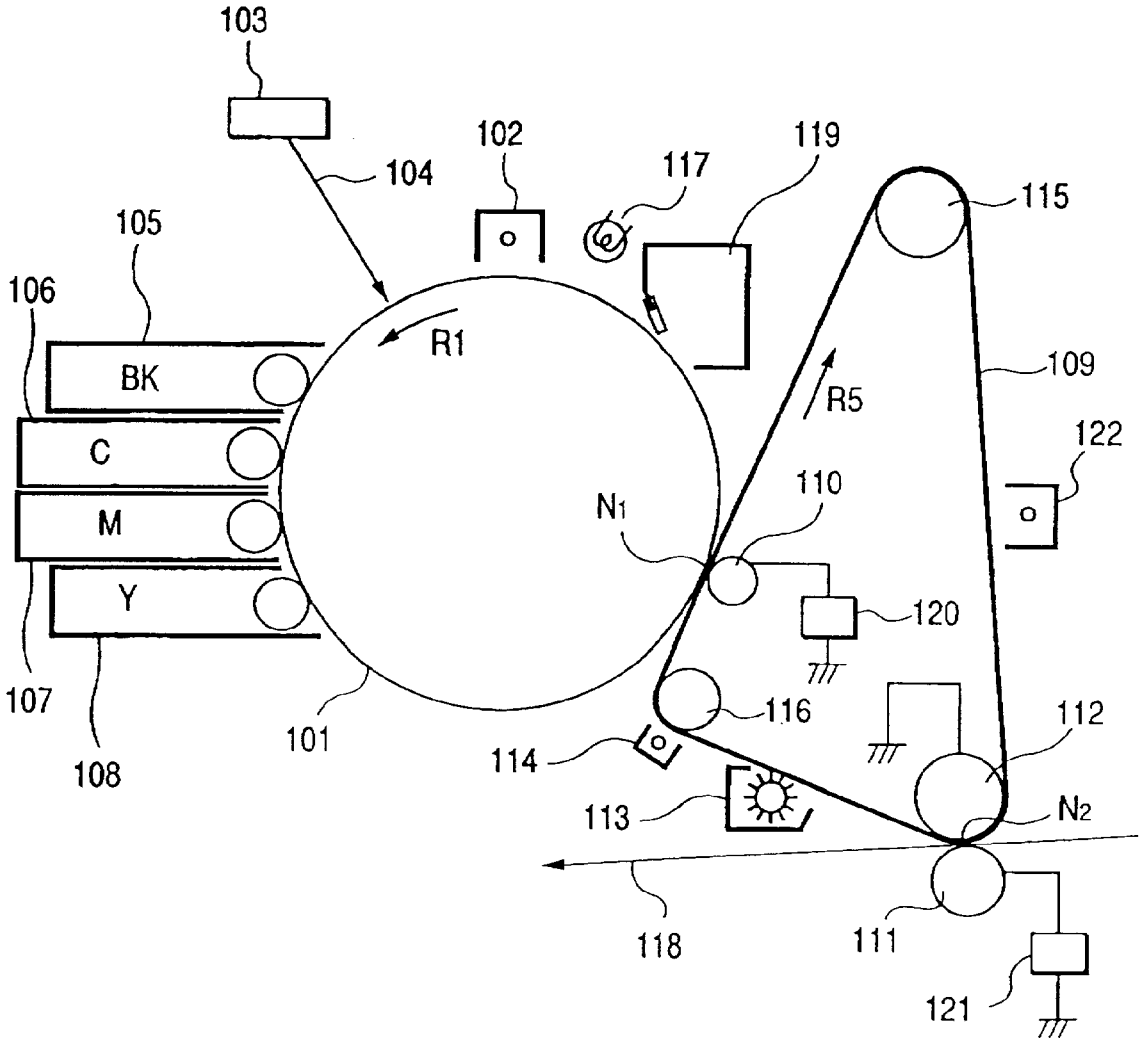
FIG. 6 is a longitudinal cross-sectional view showing the configuration of a conventional image forming apparatus.

This is because the charge amount per unit weight of toner and the saturated charge amount of the black toner used as the first color are maintained significantly lower than those of the other polymerized non-magnetic Y, M and C toners, as the conductive magnetic particles (triiron tetraoxide) added as the leak sites to the black toner. Consequently, if the black toner is used as the last color as in the conventional order of Y, M, C and B, the triboelectric charge amounts of the toners prior to the secondary transfer are not mutually matched and there will be required a post-charging (122 in FIG. 6) for matching the charges prior to the secondary transfer, but the use of the black toner as the first color as in the present embodiment allows to raise the triboelectric charge of the black toner up to the timing of the secondary transfer, whereby satisfactory secondary transfer can be achieved without the post charging. Thus the present embodiment allows to achieve satisfactory secondary transfer, even in a system utilizing toners of significantly different triboelectric charges, such as magnetic toner and non-magnetic toner.

Embodiment 3

Figure 4:
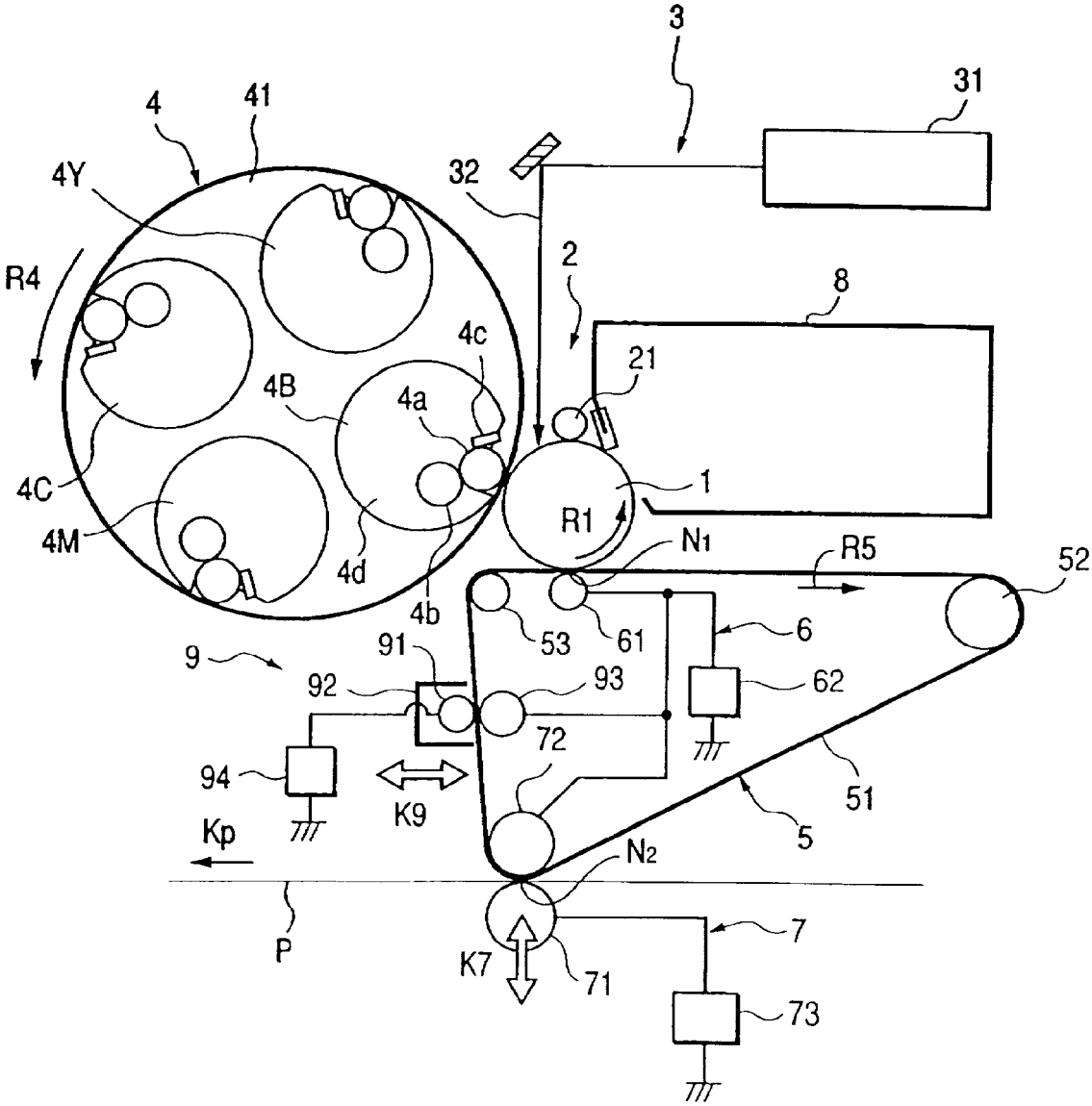
FIG. 4 is a longitudinal cross-sectional view of an image forming apparatus constituting an embodiment 3.

FIG. 4 illustrates an embodiment 3, in which the cleaning means 95 for the intermediate transfer belt 51 in the embodiment 1 is dispensed with, and the charge eliminating means 9 is utilized as charging means to charge the toner, remaining on the intermediate transfer belt 51 after the secondary transfer, in a polarity opposite to the original charging polarity of the toner (namely positive charging in the present embodiment), to recover such remaining toner to the photosensitive drum 1.

The above-described condition can be met by supplying the charging roller 91, from the cleaning bias source 94, with an AC bias voltage (about 2 to 3 kVpp, 1 to 3 kHz) for charge elimination, superposed with a DC bias voltage for positively charging the remaining toner (about 0 to +500 V higher than the secondary transfer bias applied to the backup roller 72).

Figure 5:
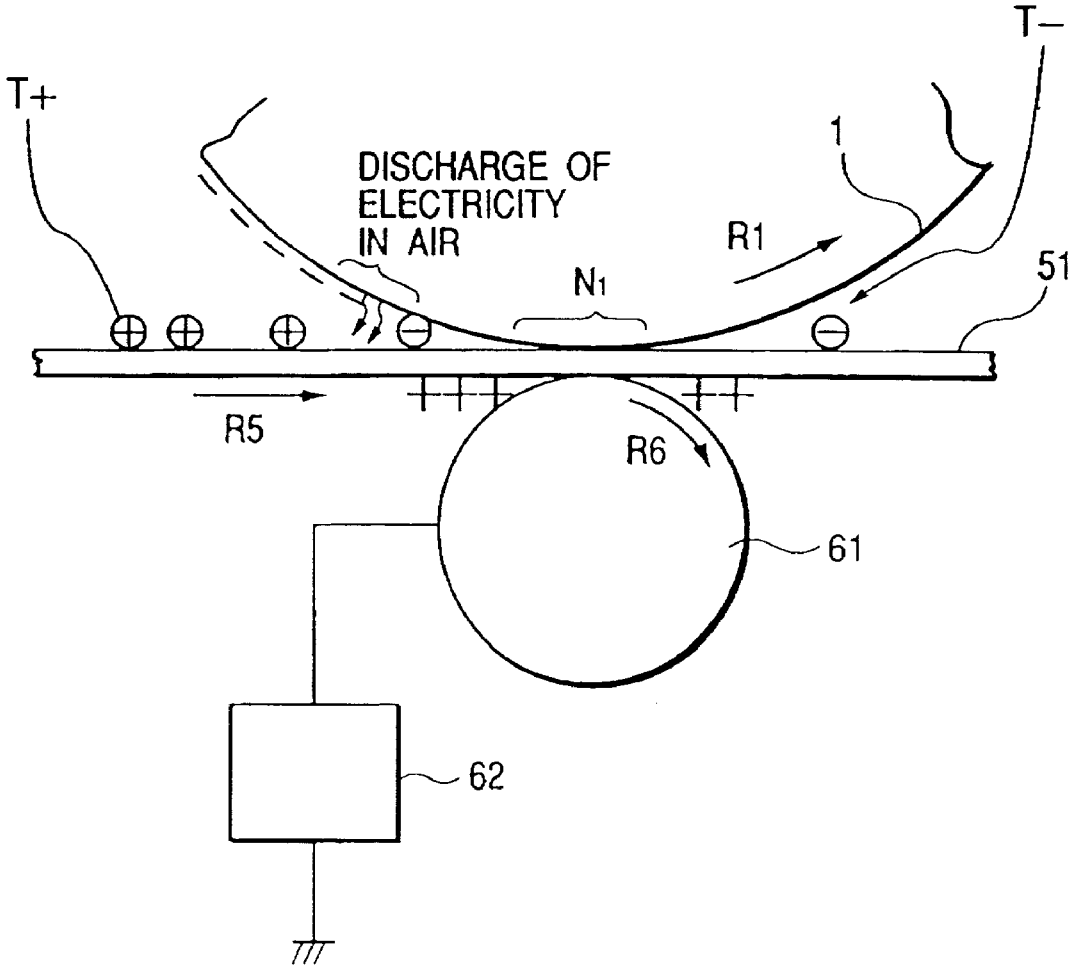
FIG. 5 is a view showing the mode of negative charging of the toner remaining after the secondary transfer by in-air discharge.

On the other hand, in order to recover the positively charged remaining toner to the photosensitive drum 1, the surface potential thereof and the bias voltage of the primary transfer roller 61 have to be within a certain range. More specifically, in the present embodiment, in order that the positively charged toner can be recovered to the photosensitive drum 1 of a negative potential, the surface potential Vs(V) of the photosensitive drum 1 and the primary bias $V_{T1}$(V) have to be such that the difference $\Delta V = Vs - V_{T1}$ is within a range from −200 to −800 V. If the absolute value of ΔV is less than 200 V, the positively charge toner cannot be electrostatically attracted to the photosensitive drum 1, while, if the absolute value is larger than 800 V, there will result an in-air discharge between the photosensitive drum 1 arid the intermediate transfer belt 51, as shown in FIG. 5, at the upstream side of the primary transfer nip N1 in the rotating direction of the photosensitive drum 1, whereby the intermediate transfer belt 51 and the remaining toner $T_+$ thereon are negatively charged (as indicated by $T_-$) immediately in front of the primary transfer nip N1 and the remaining toner $T_-$ cannot be recovered to the photosensitive drum 1.

As the surface potential Vs of the photosensitive drum 1 in the present embodiment is about −600 V in the dark portion and about −100 V in the light portion, in order to satisfy the condition for the above-mentioned cleaning operation (reverse transfer to the photosensitive drum 1), in case of effecting the primary transfer for the first color of a next image simultaneously with the cleaning operation, the primary transfer bias for the first color has to be within a range from +100 to +200 V (the remaining toner in the light portion cannot be recovered below +100 V, while an in-air discharge is generated above +200 V to hinder recovery of the remaining toner).

Thus, a strict condition is applied to the primary transfer of the first color in order to recover the toner remaining after the secondary transfer, simultaneously with the primary transfer.

Among the toners explained in the embodiments 1 and 2, the Y, M or C toner has a large triboelectric charge of about −30 $\mu$C/g on the developing sleeve 4*a*, and, if such toner is used for the first color, a sufficient transfer efficiency cannot be obtained with a primary transfer bias within the range from +100 to +200 V required for the above-described cleaning. On the other hand, the black toner explained in the: embodiments 1 and 2, of which saturated charge amount per unit weight is reduced by the leak sites, allows to achieve satisfactory transfer with the primary transfer bias of +100 to +200 V. The present embodiment employed the toners of the embodiment 2 (polymerized toners for Y, M and C, and magnetic toner for B) in the order of B, M, C and Y in the primary transfers with respective primary transfer biases of +150, +600, +700 and +800 V. As a result, as explained in the embodiment 2, the toners were adjusted to the appropriate triboelectric charge levels prior to the secondary transfer, thereby enabling satisfactory secondary transfer and moreover allowing easy recovery of the toner, remaining on the intermediate transfer belt 51 after the secondary transfer, to the photosensitive drum 1 simultaneously with the primary transfer of the first color in the next image formation. Thus, in the present embodiment, even with a simple configuration shown in FIG. 4 and lacking the cleaning means 95 shown in FIG. 1, the number N of rotations of the intermediate transfer belt 51L can be maintained as N=4×P' wherein P' is the number of images formed, thus dispensing with the additional rotation for cleaning required in the configuration shown in FIG. 1 whereby the throughput of image formation can be improved.

The order B, M, C and Y of image formation employed in the present embodiment may also be replaced by B, Y, M and C or similar other orders, and the use of the toner with the lower saturated charge amount per unit weight for the first color allows to achieve satisfactory cleaning simultaneously with the primary transfer of the first color.

The present invention has been explained by the embodiments 1 to 3, but, in any of the foregoing, similar effects can be obtained in case the intermediate transfer belt 51 is replaced by an intermediate transfer drum as the image bearing member.

Also in the foregoing embodiments 1 to 3, there has been explained a configuration of transferring the toner images of four colors from the photosensitive drum 1 to the intermediate transfer belt 51 in succession in mutually superposed manner and then collectively transferring the toner images of four colors, present on the intermediate transfer belt 51, to the transfer material P, but the present invention is not limited to such configuration and is naturally applicable also to a case of transferring the toner images of two or three colors from the photosensitive drum 1 to the intermediate transfer belt 51 in succession in mutually superposed manner and then collectively transferring such toner images of two or three colors, present on the intermediate transfer belt 51, to the transfer material P.

What is claimed is:

1. An image forming apparatus comprising:

an intermediate transfer member; and image forming means for forming toner images of plural colors in succession on said intermediate transfer member in a mutually superposed manner, the toner image formed on said intermediate transfer member being charged by said image forming means when the toner image of a next color is formed on said intermediate transfer member;

wherein the toner images of plural colors on said intermediate transfer member are electrostatically transferred to a transfer material, and wherein said image forming means charges the toner image of a color, among the toner images of plural colors formed on said intermediate transfer member, different from the last color in such a manner that the charge amount per unit weight of the toner image of said different color becomes 0.5 to 1.5 times of the charge amount per unit weight of the toner image of the last color, after the formation of the toner image of the last color on said intermediate transfer member and prior to the transfer of the toner images of plural colors on said intermediate transfer member to the transfer material.

2. An image forming apparatus according to claim 1, wherein said image forming apparatus includes an image bearing member and developing means for forming a toner image on said image bearing member, wherein the charge amount per unit weight of the toner of a first color in said developing means is smaller than the charge amount per unit weight of the toners of subsequent colors.

3. An image forming apparatus according to claim 1, wherein the saturated charge amount per unit weight of the toner of the first color is smaller than the saturated charge amount per unit weight of the toners of the subsequent colors.

4. An image forming apparatus according to claim 2 or 3, further comprising charging means for charging the toner, which remains on said intermediate transfer member after electrostatic transfer of the toner images of plural colors from said intermediate transfer member, to the transfer material in a polarity opposite to a normal polarity of said toner; wherein, where said image forming means and said intermediate transfer member are mutually opposed, an electric field is generated by said image forming means for forming the toner image of a first color of a next image on said intermediate transfer member, simultaneous with the transfer of said remaining toner, charged by said charging means, to said image bearing member.

5. An image forming apparatus according to claim 2, wherein the charging polarity of said image bearing member is same as a normal charging polarity of the toner.

6. An image forming apparatus according to claim 1, wherein the toner of the first color includes conductive particles.

7. An image forming apparatus according to claim 6, wherein the toner of the first color is magnetic toner.

8. An image forming apparatus according to claim 7, wherein the toners subsequent to the toner of the first color are non-magnetic toners.

9. An image forming apparatus according to claim 7, wherein the toner of the first color is black colored toner.

10. An image forming apparatus according to claim 2, wherein the volumic resistivity of said intermediate transfer member is within a range of $10^{12}$ to $10^{16}$ Ωcm.

11. An image forming apparatus according to claim 10, wherein a voltage applied to said image forming means is increased in succession along with the transfers of toner images of each color from said image bearing member to said intermediate transfer member.

12. An image forming apparatus comprising:

an image bearing member;

developing means for forming a toner image on said image bearing member;

an intermediate transfer member; and transfer charging means for electrostatically transferring the toner images of plural colors in succession, in a mutually superposed manner, from said image bearing member to said intermediate transfer member, the toner image transferred onto said intermediate transfer member being charged by said transfer charging means at the transfer of the toner image of a next color from said image bearing member to said intermediate transfer member by said transfer charging means;

wherein the toner images of plural colors on said intermediate transfer member are electrostatically transferred onto a transfer material, wherein the charge amount per unit weight of the toner of a last color in said developing means is 1.5 to 4.0 times of the charge amount per unit weight of the toner of a first color in said developing means, and wherein the difference between the charge amount per unit weight of the toner image of the first color, transferred from said image bearing member to said intermediate transfer member, after chargings of a predetermined number by said transfer charging means, and the charge amount per unit weight of the toner of the first color on said developing means is smaller than the difference between the charge amount per unit weight of the toner image of the last color, transferred from said image bearing member to said intermediate transfer member, after chargings of a predetermined number by said transfer charging means, and the charge amount per unit weight of the toner of the last color on said developing means.

13. An image forming apparatus according to claim 12, wherein the charge amount per unit weight of the toner image of the first color transferred onto said intermediate transfer member, after the transfer of the toner image of the last color onto said intermediate transfer member and prior to the transfer of the toner images of plural colors on said intermediate transfer member to the transfer material, is 0.5 to 1.5 times of the charge amount per unit weight of the toner image of the last color.

14. An image forming apparatus according to claim 12, wherein the charge amount per unit weight of the toners subsequent to the toner of the first color in said developing means is 1.5 to 4.0 times of the charge amount per unit weight of the toner of the first color in said developing means.

15. An image forming apparatus according to claim 14, wherein the difference between the charge amount per unit weight of the toner image of the first color, transferred from said image bearing member to said intermediate transfer member, after chargings of a predetermined number by said transfer charging means, and the charge amount per unit weight of the toner of the first color on said developing means is smaller than the difference between the charge amount per unit weight of the toner image of a subsequent color, transferred from said image bearing member to said intermediate transfer member, after chargings of a predetermined number by said transfer charging means, and the charge amount per unit weight of the toner of the last color on said developing means.

16. An image forming apparatus according to claim 15, wherein the charge amount per unit weight of a toner image subsequent to the toner image of the first color, after the transfer of the toner image of the last color onto said intermediate transfer member and prior to the transfer of the toner images of plural colors on said intermediate transfer member to the transfer material, is 0.5 to 1.5 times of the charge amount per unit weight of the toner image of the last color.

17. An image forming apparatus according to claim 12, wherein the saturated charge amount per unit weight of the toner of the first color is smaller than the saturated charge amount per unit weight of a toner subsequent to the toner of the first color.

18. An image forming apparatus according to claim 12, further comprising charging means for charging the toner, which remains on said intermediate transfer member after electrostatic transfer of the toner images of plural colors from said intermediate transfer member to the transfer material, in a polarity opposite to a normal polarity of said toner; wherein, where said image bearing member and said intermediate transfer member are mutually opposed, an electric field is generated for transferring the toner image of a first color of a next image on said image bearing member onto said intermediate transfer member, simultaneous with the transfer of said remaining toner, charged by said charging means, to said image bearing member.

19. An image forming apparatus according to claim 12, wherein the charging polarity of said image bearing member is same as a normal charging polarity of the toner.

20. An image forming apparatus according to claim 12, wherein the toner of the first color image formed includes conductive particles.

21. An image forming apparatus according to claim 20, wherein the toner of the first color image formed is magnetic toner.

22. An image forming apparatus according to claim 21, wherein the toners used for forming color images subsequent to the formation of a toner image of the first color are non-magnetic toners.

23. An image forming apparatus according to claim 21, wherein the toner of the first color image formed is black colored toner.

* * * * *

UNITED STATES PATENT AND TRADEMARK OFFICE

CERTIFICATE OF CORRECTION

PATENT NO. : 6,097,919

DATED : August 1, 2000

INVENTOR(S): AKIHIKO TAKEUCHI, ET AL.

It is certified that error appears in the above-identified patent and that said Letters Patent is hereby corrected as shown below:

COLUMN 1:
Line 53, "details." should read --detail.--.

COLUMN 3:
Line 52, "methods" should read --method--.

COLUMN 5:
Line 11, "the-one" should read --one--, and "color" should read --colors--; and
Line 18, "of" should be deleted.

COLUMN 6:
Line 55, "ω.cm" should read --Ω.cm--.

COLUMN 9:
Line 21, "this" should read --the--; and
Line 65, "be" should read --been--.

COLUMN 10:
Line 43, "cut" should read --out--.

COLUMN 11:
Line 3, "present:" should read --present--.

UNITED STATES PATENT AND TRADEMARK OFFICE

CERTIFICATE OF CORRECTION

PATENT NO. : 6,097,919

DATED : August 1, 2000

INVENTOR(S): AKIHIKO TAKEUCHI, ET AL.

It is certified that error appears in the above-identified patent and that said Letters Patent is hereby corrected as shown below:

COLUMN 12:
Line 61, "charge" should read --charged--; and
Line 65, "arid" should read --and--.

Signed and Sealed this

Twenty-second Day of May, 2001

Nicholas P. Godici

*Attest:*

NICHOLAS P. GODICI

*Attesting Officer*

*Acting Director of the United States Patent and Trademark Office*